US008246144B2

(12) United States Patent
Katano et al.

(10) Patent No.: US 8,246,144 B2
(45) Date of Patent: Aug. 21, 2012

(54) INKJET PRINTING APPARATUS

(75) Inventors: Ryoichi Katano, Kawasaki (JP); Masahiro Kobayashi, Tokyo (JP); Yaado Sakata, Tokyo (JP); Hiroyuki Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 12/819,501

(22) Filed: Jun. 21, 2010

(65) Prior Publication Data

US 2011/0007113 A1 Jan. 13, 2011

(30) Foreign Application Priority Data

Jul. 9, 2009 (JP) ..... 2009-162908

(51) Int. Cl.
*B41J 2/165* (2006.01)

(52) U.S. Cl. ..... 347/34; 347/22

(58) Field of Classification Search ..... None
See application file for complete search history.

(56) References Cited

U.S. PATENT DOCUMENTS

| | | | | |
|---|---|---|---|---|
| 6,220,693 | B1 * | 4/2001 | Bode et al. | 347/34 |
| 6,886,905 | B2 | 5/2005 | McElfresh et al. | |
| 2003/0210294 | A1 | 11/2003 | Fredrickson et al. | |

FOREIGN PATENT DOCUMENTS

| | | | |
|---|---|---|---|
| CN | 1434770 | A | 8/2003 |
| JP | 2004330637 | | 11/2004 |
| JP | 2006248133 | A | 9/2006 |

OTHER PUBLICATIONS

Office Action—Chinese Patent Application No. 201010224265.1, State Intellectual Property Office of the People's Republic of China, Apr. 6, 2012.

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

An inkjet printing apparatus which enables printing with high print quality is provided. For that purpose, a pair of airflow guides are provided at intermediate positions between each adjacent two of the printing heads arrayed in a travelling direction of a carriage, the pair of the airflow guides respectively located right and left in a direction perpendicular to the travelling direction of the carriage.

8 Claims, 13 Drawing Sheets

110a

110b

110c

110d

INKJET PRINTING APPARATUS

BACKGROUND OF THE INVENTION

1. Field of the Invention

The present invention relates to an inkjet printing apparatus which includes an inkjet printing head configured to eject ink and moves the inkjet printing head relative to a print medium to perform printing on the print medium by means of ink droplets ejected from a liquid ejecting part.

2. Description of the Related Art

For an inkjet printing apparatus, improvements in image quality and colorfulness of a printed image have been required in recent years. Consequently, for the purpose of achieving superior fineness of a printing head, an inkjet printing apparatus in recent years has come to have a largely increased number of ejection ports arrayed at a high density, and thereby to eject smaller ink droplets. Along with these changes, a phenomenon has become increasingly pronounced in which, when ink ejected from a large number of nozzles as printing is performed, an extremely fine ink mist accompanying ink droplets forming a printed image is scattered into a spray-like condition.

An ink mist scattered between a printing head of an inkjet printing apparatus and a print medium adheres to constituent elements of the printing apparatus, such as a drive mechanism. Such adherence of the ink mist to the constituent elements of the printing apparatus disturbs normal ink ejection, and therefore is a problem that must be addressed in accomplishing printing of high image quality. There are two possible approaches as countermeasures against troubles like this caused by an ink mist. One is an approach for reducing generation of the mist itself by employing an appropriate ink formula or drive method. The other is an approach for reducing adherence of an ink mist to the print medium and to the constituent elements of the printing apparatus by controlling behavior of the mist between the printing head and the print medium.

In the former one of these two approaches, it is known that generation of minute ink droplets tends to be suppressed by an ink formula capable of increasing ink viscosity. However, there is a trade-off relationship between ink viscosity and an ink ejection speed. It can be safely said that development has not yet been achieved for ink capable of suppressing generation of a mist even with an ejection speed kept high enough to achieve a high image quality. As an example based on the latter approach, there is an inkjet printing apparatus including a flow regulator installed in a front side of the printing head in a travelling direction of a carriage, and being capable of preventing generation of a complex airflow by using the flow regulator and thereby reducing adherence of an ink mist to the driving mechanism.

However, a front shape of the carriage in the scanning direction is not the only factor influencing an airflow between the printing head of the inkjet printing apparatus and the print medium. Under a printing condition with a high drive frequency per nozzle for such a case as solid printing with ink of only one color, momentum held by ejected ink droplets are transmitted to the air, whereby a complex airflow curling up from the print medium toward the printing head is caused between the printing head and the print medium.

This airflow heading for the printing head will be described below. When ink droplets are ejected from the printing head toward the print medium, airflows from the printing head toward the print medium are generated in association with movements of the ink droplets at first. Then, when reaching the print medium, these airflows turn around by bumping into the print media, and then form airflows oppositely heading toward the printing head. Such an airflow field is inevitably formed when ink droplets are ejected, and therefore, cannot be controlled with the flow regulator in the front side of the carriage in the scanning direction.

Such airflows heading for the printing head cause an ink mist to adhere to a face surface which is an ink ejecting surface of the printing head. During printing, ink is repeatedly ejected and the ink mist adhering to the face surface is accumulated, whereby wetting of ink attributable to the mist is formed around nozzle arrays. This wetting causes color mixing of ink and improper ejection, and therefore is as a factor of image quality reduction.

Conceivable countermeasures for solving this problem are restoration operations such as suction and wiping at a home position. When time required for the printing and increase of wasted ink are taken into consideration, however, it is not preferable to frequently perform such a restoration operation. In an inkjet printing apparatus, these airflows curling up between the face surface and the print medium are a stubborn obstacle to simultaneous achievement of high image quality and high-speed printing.

Here, when adherence of the mist to the face surface is reduced, a larger amount of the mist is scattered toward an entirety of a housing from a region between the printing head and the print medium; however, this problem can be effectively handled by use of a mist collecting mechanism installed in the housing.

In Japanese Patent Laid-open No. 2004-330637, as a constituent element which controls behavior of ink mist, fans are installed in front and back, in a scanning direction of a carriage, of a region between a printing head and a print medium. However, in such a method for controlling an airflow in a scanning direction of a carriage, a nozzle array following a preceding nozzle array in the scanning direction receives an influence of airflows formed by the preceding nozzle array. Consequently, it is difficult to give uniform air flowing conditions to all of the plural nozzle arrays lined up in the carriage scanning direction. In inkjet printing, an inflow of air between the printing head and the print medium influences landing positions of ink droplets, and therefore relates to image quality to a large extent. In order to achieve both reduction of adherence of an ink mist to a face surface and high image quality, it is preferred to make inflows of air around the plural provided nozzle arrays even and uniform.

It is known that airflows curling up between the printing head and the print medium are attenuated relative to an increase in an inflow of air flowing into a space between the printing head and the print medium. However, there is no effective means for effectively increasing an air flowing into the space between the printing head and the print medium. For this reason, airflows cannot be prevented from heading for the printing head, whereby print quality is reduced due to such reasons as adherence of an ink mist to the face surface.

SUMMARY OF THE INVENTION

Consequently, an object of the present invention is to realize an inkjet print apparatus which enables printing with high printing quality.

An inkjet printing apparatus of the present invention is an inkjet printing apparatus including a carriage on which a plurality of printing heads are mountable, the inkjet printing apparatus configured to perform printing by ejecting ink from the printing heads to a print medium while reciprocating the carriage, wherein a plurality of the printing heads are mounted in parallel and to project from a carriage surface of the carriage, the carriage surface facing the print media; and the carriage surface is provided with airflow guides projecting from the carriage surface, the airflow guides being configured to guide air, flowing along lateral surfaces of the respective printing heads during travelling of the carriage, into spaces between the printing heads adjacent to each other.

According to an inkjet printing apparatus of the present invention, a printing head is mounted in such a way as to project from a carriage surface of a carriage, the carriage surface facing a print medium. Further, airflow guides, which guide air into spaces between adjacent printing heads, are provided on the carriage surface in such a way as to project from the carriage surface, the air flowing along lateral sides of the printing head. Thereby, an inkjet print apparatus which enables printing with high printing quality can be provided.

Further features of the present invention will become apparent from the following description of exemplary embodiments (with reference to the attached drawings).

DESCRIPTION OF THE EMBODIMENTS

First Embodiment

A first embodiment of the present invention will be described below with reference to the drawings.

Figure 1:
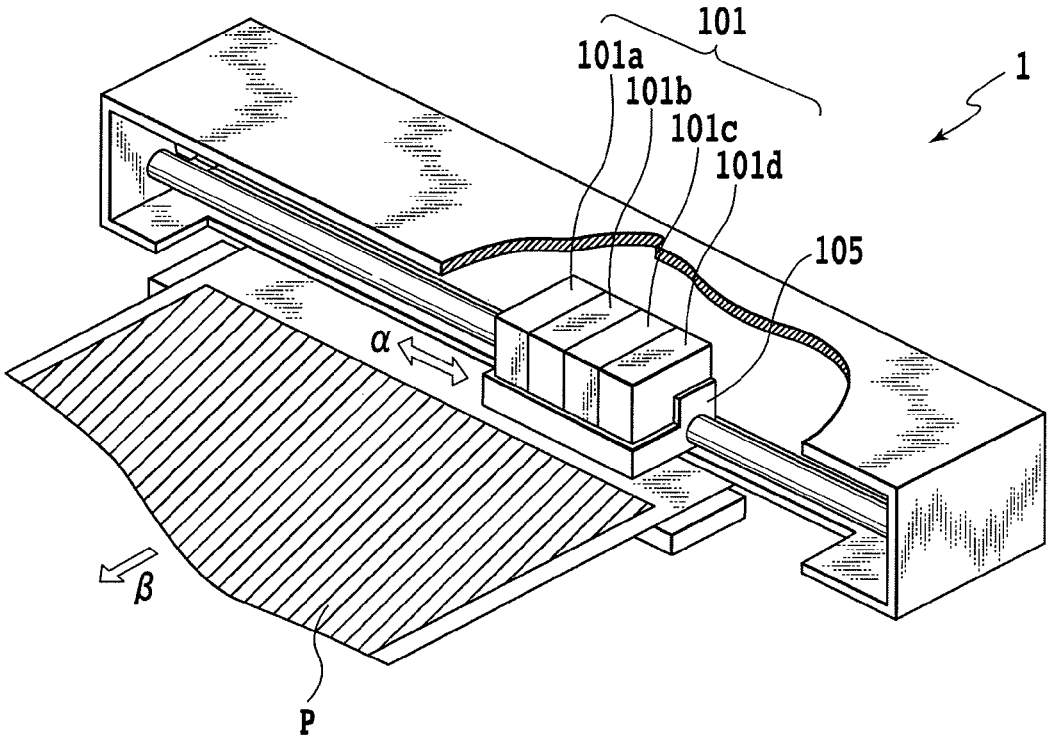
FIG. 1 is a view schematically showing a configuration of an inkjet printing apparatus of a first embodiment.

FIG. 1 is a perspective view schematically showing a configuration of an inkjet printing apparatus (hereinafter, also referred simply to a printing apparatus) of the present embodiment. The printing apparatus 1 of the present embodiment performs printing by having two following operations alternately repeated: one operation in which a carriage 105 capable of mounting a printing head 101 thereon ejects ink while reciprocating on a print medium P in a main scanning direction (direction indicated by an arrow $\alpha$); and the other operation in which the carriage 105 transfers the print medium P in a sub scanning direction (direction indicated by an arrow $\beta$). The printing head 101 includes nozzle arrays in which multiple nozzles are formed into arrays, and multiple ones of the nozzle arrays are provided to each color of ink to be ejected.

Figure 2A:
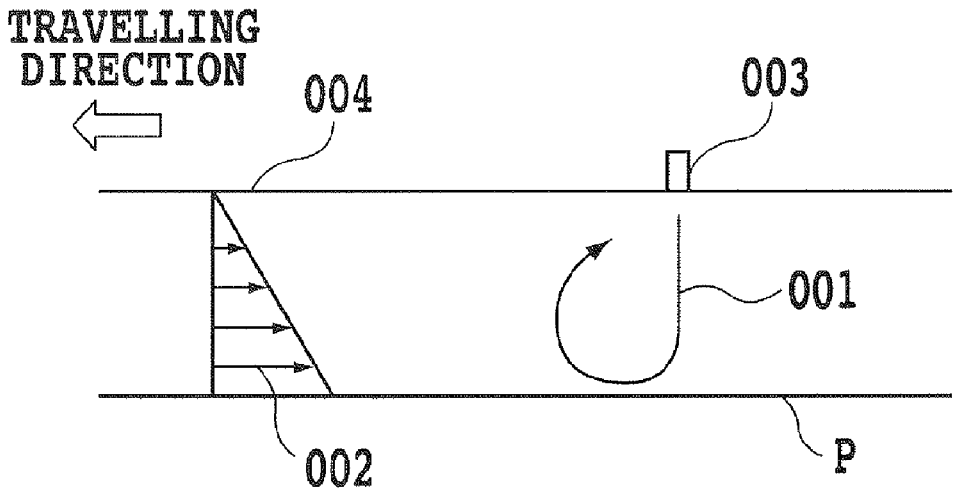
FIG. 2A is a side view schematically showing a relationship between an inflowing airflow and a curling-up airflow in a conventional printing apparatus.
Figure 2B:
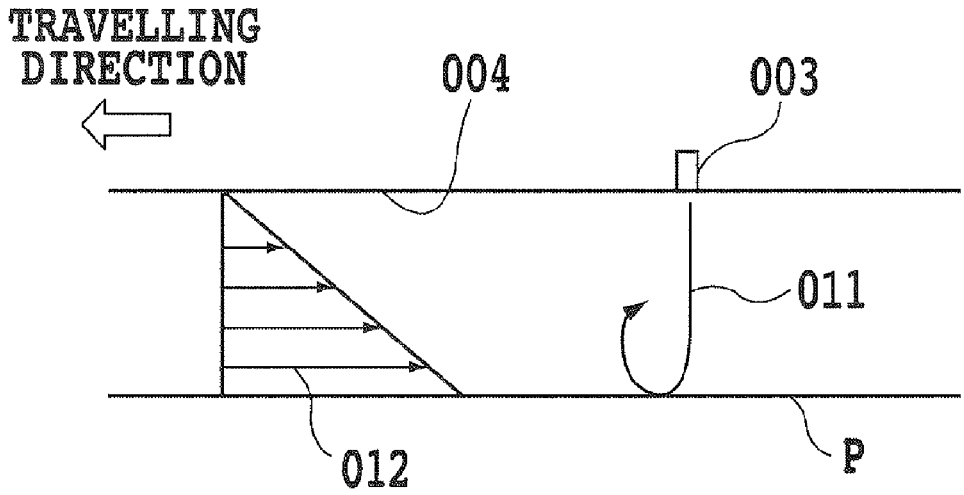
FIG. 2B is a side view schematically showing a relationship between an inflowing airflow and a curling-up airflow in a conventional printing apparatus.

Each of FIGS. 2A and 2B is a side view schematically showing a relationship between a relatively inflowing airflow 002 (012) and a curling-up airflow 001 (011) in a space between a printing head and a print medium P in a conventional printing apparatus. In a case shown in FIG. 2A where an amount of air flowing into the space between the printing head and the print medium P is small, the inertia of the inflowing air is too small to negate the curling-up airflow 001. Consequently, an ink mist curls up in front of a nozzle array 003 by riding on the airflow 001, then takes a route heading for the neighborhood of the nozzle array 003, and then forms a wetting by adhering onto a face surface 004 of the printing head.

On the other hand, in a case shown in FIG. 2B where an amount of air flowing into the space between the printing head and the print medium P is large, compared with FIG. 2, the inertia of the inflowing air is so large that the restrained curling-up airflow 011 is formed. Due to this restraining effect, an ink mist cannot obtain momentum which is large enough to cause the ink mist to head for the face surface 004, whereby an amount thereof adhering onto the face surface 004 is reduced.

Figure 3A:
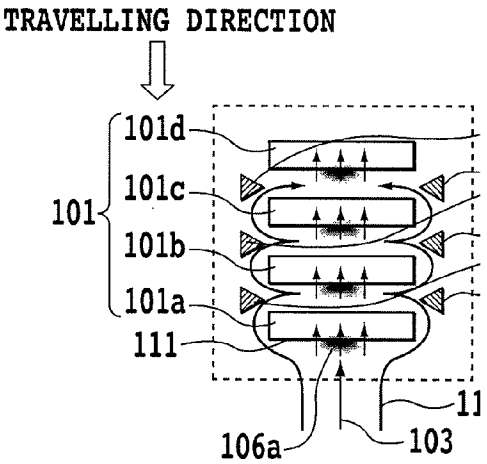
FIG. 3A is a schematic view showing the relationship between respective print heads and each airflow.
Figure 3B:
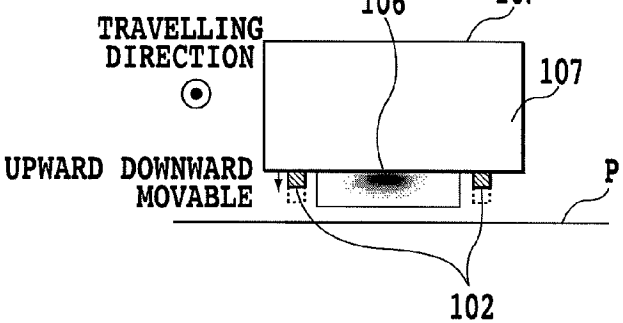
FIG. 3B is a schematic view showing the relationship between the respective print heads and each airflow.
Figure 3C:
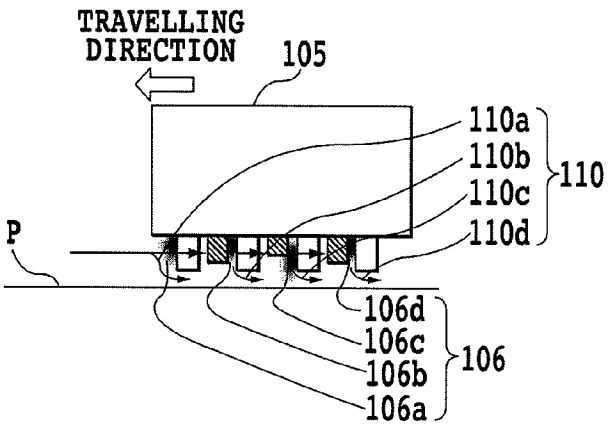
FIG. 3C is a schematic view showing the relationship between the respective print heads and each airflow.
Figure 4A:
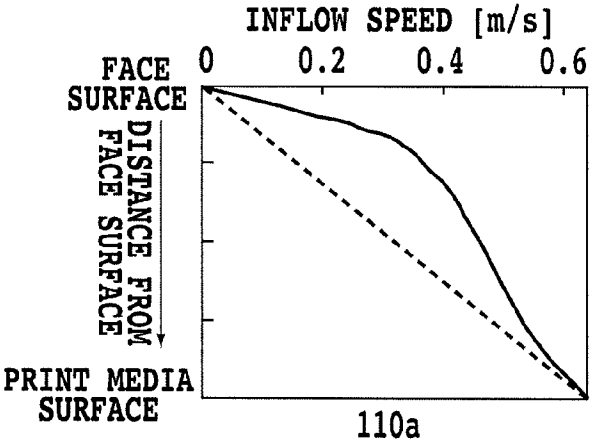
FIG. 4A is a diagram showing a result of a fluid simulation to which a neighborhood of a printing head of the first embodiment is subjected.
Figure 4B:
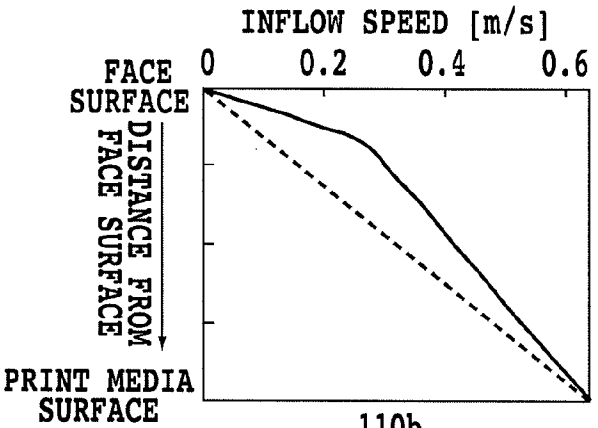
FIG. 4B is a diagram showing a result of a fluid simulation to which the neighborhood of a printing head of the first embodiment is subjected.
Figure 4C:
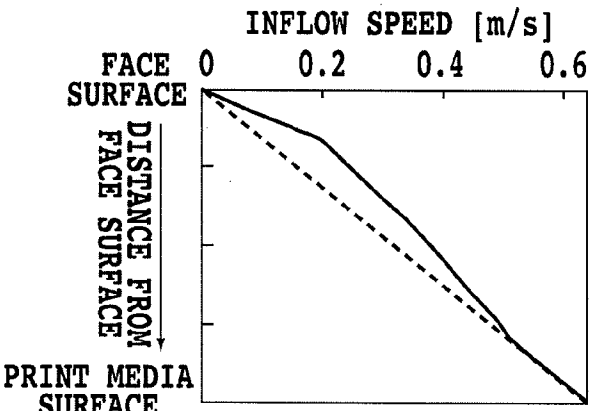
FIG. 4C is a diagram showing a result of a fluid simulation to which the neighborhood of a printing head of the first embodiment is subjected.
Figure 4D:
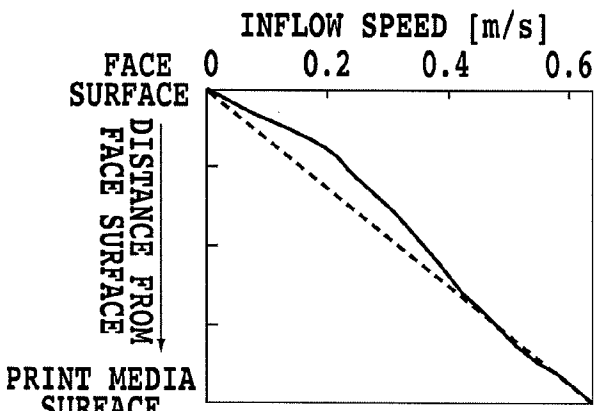
FIG. 4D is a diagram showing a result of a fluid simulation to which the neighborhood of a printing head of the first embodiment is subjected.

Each of FIGS. 3A to 3C is a schematic view showing a relationship between an inkjet printing head 101 and each airflow, the inkjet printing head 101 being applicable to the present embodiment. The printing head 101 is installed in such a state as to project from a carriage surface 107 of the carriage 105, the carriage surface 107 facing the print medium P. Four printing heads 101*a* to 101*d* are installed on the carriage 105 in such a state as in parallel and to project from the carriage surface 107 of the carriage 105. Additionally, pairs of airflow guides 102 are provided on the carriage surface 107 respectively right and left in a direction perpendicular to a travelling direction of the carriage 105. Each pair of the airflow guides 102 is provided at intermediate positions between two adjacent ones of the printing heads 101 arrayed in the travelling direction.

Specifically, each pair of the airflow guides 102 is provided on the carriage surface 107 in respective positions extending from a space between two adjacent ones of the printing head, and are disposed so that the pair may face each other in a direction intersecting the traveling direction of the carriage 105. These airflow guides 102 are provided, as shown in FIG. 3B, in such a way as to be upward downward movable with respect to the carriage surface 107 by means of a movable mechanism such as a gear. Thereby, projected areas of these airflow guides 102 with respect to the travelling direction are adjustable. In other words, a configuration is adopted where a degree of projection of these airflow guides 102 from the carriage surface 107 is changeable. While the carriage 105 is travelling, high-pressure regions 106 (106*a* to 106*d*) on front edges of the respective printing heads 101 (101*a* to 101*d*) attached in a projecting state are formed by an airflow 103 flowing toward the carriage 105 from front (refer to FIGS. 3A and 3C).

The thus formed high-pressure regions 106 generate an airflow flowing into a space between each of the respective printing heads 101 and the print medium P where a pressure is lowered due to travelling of the carriage 105. The airflows generated due to such pressure differences induce the streams 110 flowing into the spaces between the respective printing heads 101 and the print medium P. Thereby, inflows of air flowing into the spaces between the respective printing heads 101 and the print medium P are increased. Also, in the neighborhoods of the respective printing heads 101, airflows 112 flowing along lateral sides of the printing heads 101 are generated (refer to FIG. 3A). The high-pressure regions 106 are formed in front edges of the printing head 101*b*, printing head 101*c* and printing head 101*d* as well by having these airflows 112 guided by the airflow guides 102 into spaces each between adjacent two of the printing heads 101. Additionally, since the airflow guides 102 are made upward downward movable, not only inflows toward the respective printing heads 101 are controllable, but also the same effect can be obtained in both outward and homeward directions. Thereby, the airflow guides 106 can correspond even to a change in a carriage travelling speed as a result of selection of a printing mode.

The carriage 105 is configured to travel at a speed of 25 ips. Here, lower surfaces of the respective guides 102 are at the same level as a face surface of the printing heads 101. If a relative system viewed from the carriage 105 is supposed, the airflow 103, flowing in from the front, bumps into a front edge of the printing head 101*a* and forms the high-pressure region 106*a*. From the high-pressure region 106*a*, a stream 110 is induced with an increased inflow, the stream 110 flowing into spaces between the respective printing heads and the print medium. Additionally, a high-pressure region 106*b* is formed in the neighborhood of a front edge of the printing head 101*b* since the airflow guides 102 guide the airflows 112, which flow along both of the lateral sides of the printing heads 101, into a space between the printing heads (101*a* to 101*b*). Continuation of this structure forms high-pressure regions 106*c* and 106*d* in front edges of the respective printing heads following the above ones in the rear thereof, whereby inflow of air into spaces between adjacent ones of the printing heads is facilitated. This makes it possible to increase the streams (110*b* to 110*d*) between the respective printing heads 101 and the print medium P.

Adherence of an ink mist onto the face surface of the printing heads 101 was reduced by thus increasing airflows between the respective printing heads 101 and the print medium P and thereby suppressing generation of airflows curling up toward the printing heads. Details of verification on how this reduction of adherence of an ink mist is attained will be described below, the verification using a fluid simulation.

FIGS. 4A to 4D are diagrams showing results of the fluid simulation to which the neighborhoods of the respective printing heads of the present embodiment are subjected, and are graphs showing inflow speeds of the streams 110*a* to 110*d* between the respective printing heads and the print medium P in the front edges of the respective printing heads.

Figure 5A:
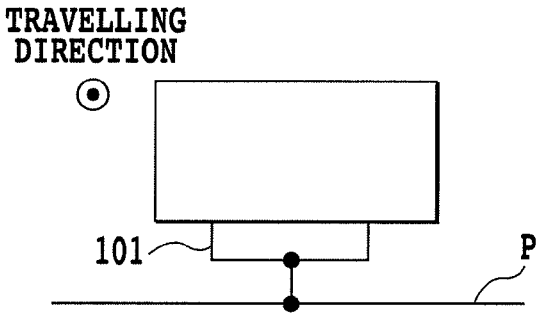
FIG. 5A is a view showing a state of a probe, used in the fluid simulations, from a front side thereof in a direction of travelling of a carriage.
Figure 5B:
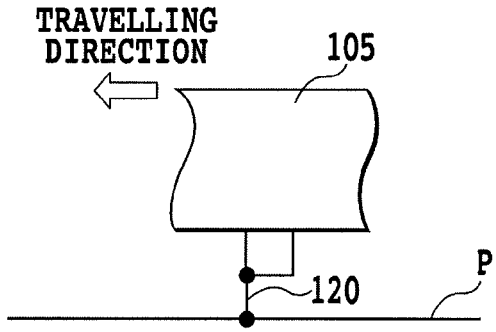
FIG. 5B is a view showing a state of a probe, used in the fluid simulations, from a lateral side thereof in the direction of travelling of the carriage.

FIGS. 5A and 5B are views showing a state of a probe 120 from a front side and a lateral side thereof, respectively, in a travelling direction of the carriage 105, the probe 120 being used in the fluid simulation.

From FIGS. 4A to 4D, it is found that airflows into spaces between the respective printing heads are facilitated, particularly with respect to the first and second printing heads in the travelling direction. Based on this result, superiority of the present embodiment has been confirmed.

As described above, the pair of the airflow guides 102 are provided, in such a manner that these airflow guides 102 are respectively located right and left in a direction perpendicular to the travelling direction of the carriage 105, at intermediate positions between adjacent ones of the printing heads 101 arrayed in the traveling direction of the carriage 105. Adherence of an ink mist onto the face surface of the printing heads was prevented by suppressing the airflows curling up toward the printing heads by the utilization of airflows generated by these airflow guides 102. Thereby, an inkjet printing apparatus which enables printing with high printing quality can be obtained.

Second Embodiment

A second embodiment of the present invention will be described below with reference to the drawings. Note that, since a configuration of the present embodiment is basically the same as that of the first embodiment, only characteristic features of the configuration will be described below.

Figure 6A:
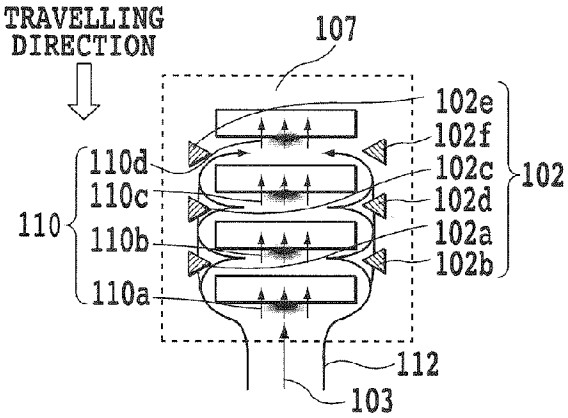
FIG. 6A is a view showing a carriage included in the printing apparatus of the first embodiment.
Figure 6B:
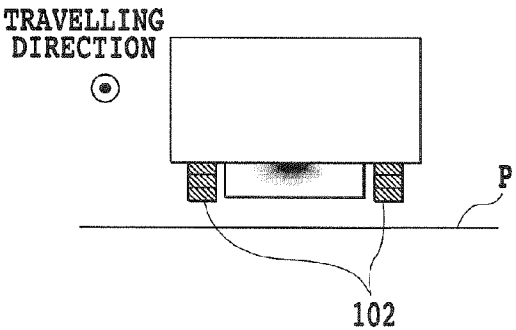
FIG. 6B is a view showing the carriage included in the printing apparatus of the first embodiment.
Figure 6C:
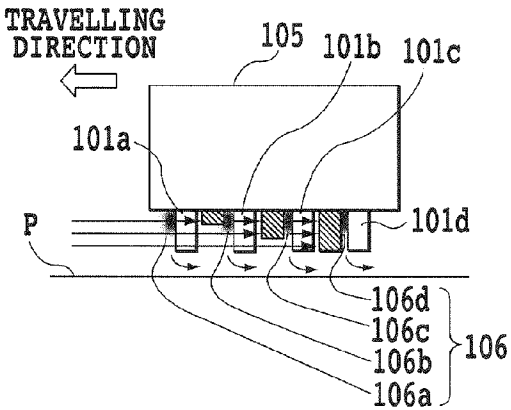
FIG. 6C is a view showing the carriage included in the printing apparatus of the first embodiment.
Figure 7A:
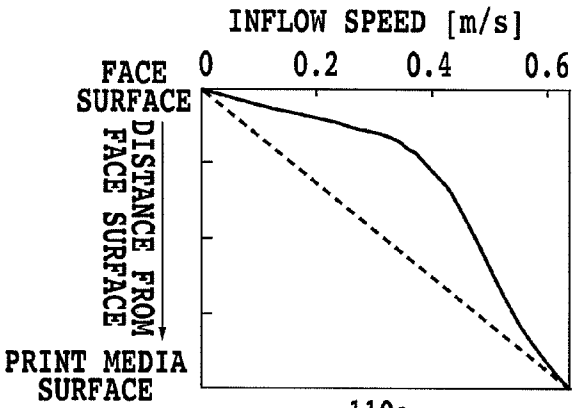
FIG. 7A is a diagram showing a result of a fluid simulation to which a neighborhood of a printing head of a second embodiment is subjected.
Figure 7B:
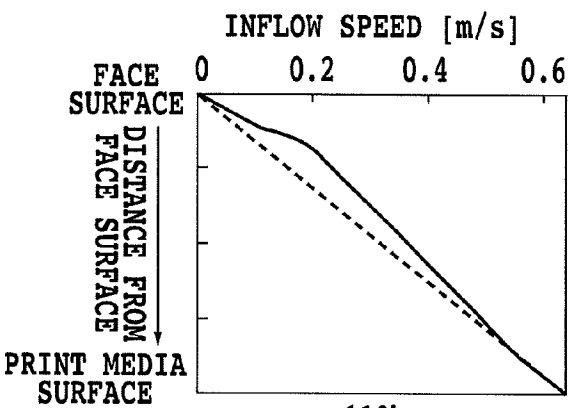
FIG. 7B is a diagram showing a result of a fluid simulation to which the neighborhood of the printing head of the second embodiment is subjected.
Figure 7C:
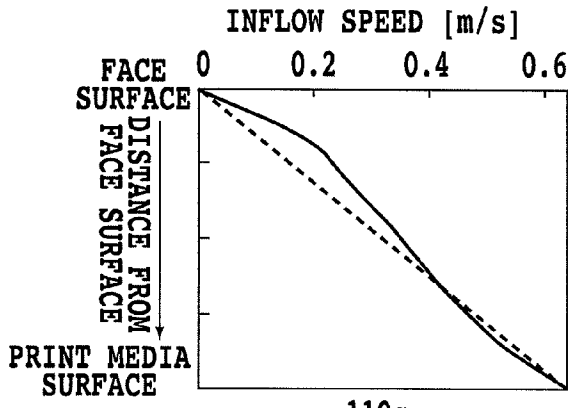
FIG. 7C is a diagram showing a result of a fluid simulation to which the neighborhood of the printing head of the second embodiment is subjected.
Figure 7D:
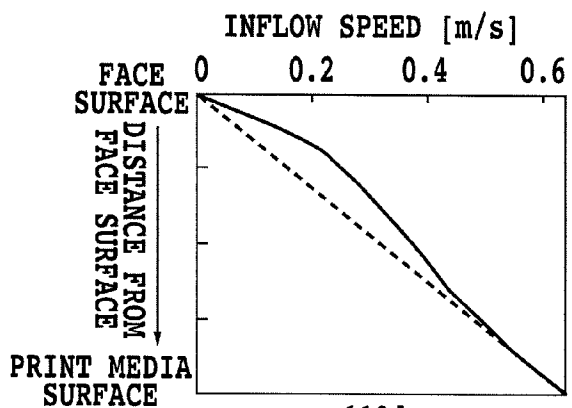
FIG. 7D is a diagram showing a result of a fluid simulation to which the neighborhood of the printing head of the second embodiment is subjected.

FIGS. 6A to 6C are views showing the carriage 105 which is included in a printing apparatus of the present embodiment and has a structure with projecting heads. As in the case of the first embodiment, airflow guides 102 of the present embodiment also are attached to the carriage surface 107 by means of a mechanical element, such as a gear, in such a way as to be upwardly and downwardly movable, and projection amounts of the respective airflow guides 102 are adjustable. Additionally, while the projection amounts of the respective airflow guides 102 are all equal in the first embodiment, the projection amounts thereof are made different in the present embodiment.

In the airflow guides 102 of the present embodiment, a projection amount of each of airflow guides 102*a* and 102*b* located at the most anterior position in the direction of travelling is set to one third of a projection amount of the respective printing head. A projection amount of each of airflow guides 102*c* and 102*d* subsequent to the airflow guides 102*a* and 102*b* is set to two thirds of the projection amount of the respective printing head. Then, a projection amount of each of airflow guides 102*e* and 102*f* located at the most posterior position is set to the same as the projection amount of the respective printing head.

The high-pressure region 106*a* is formed in a front edge of the printing head 101*a* by travelling of the carriage 105. Additionally, the airflow guides 102*a* to 102*f*, whose projection amounts are made different as described above, guide streams into a space between each adjacent two of the printing heads, the streams escaping toward both of the lateral sides of the most anterior head 101*a*. The airflow guides 102*a* to 102*f* thereby form the high-pressure regions 106*b* to 106*d* in the front edges of the printing heads following the most anterior one. Inflow of air into spaces between the respective printing heads and the print medium is facilitated from the respective high-pressure regions 106 as in the case of the first embodiment. It is thereby made possible to obtain streams 110*b* to 110*d* flowing into spaces between the respective printing heads and the print medium in the following printing heads 101*b* to 101*d*.

However, the projection amounts of the airflow guides 102 are made different, so that projecting areas thereof along the travelling direction have a distribution. Thereby, generation of pressure differences among the high-pressure regions is prevented, which is attributable to different positions of corresponding ones of the printing heads. That is, effective formation of the high-pressure region 106*d* is enabled also in the front edge of the head 101*d* located even in the most anterior position, and inflows of air flowing into the spaces between the respective printing head and the print medium are efficiently provided. Thereby, it is made possible to provide appropriate inflows to the respective printing heads under both conditions in the outward and homeward directions, respectively.

In printing performed by the printing apparatus of the present embodiment, adherence of an ink mist onto the face surface was reduced even with respect to the printing heads located at positions rear with respect the carriage travelling direction.

FIGS. 7A to 7D are diagrams showing results of a fluid simulation to which the neighborhoods of the respective printing heads in the present embodiment are subjected, and are graphs of inflow speeds of the streams 110*a* to 110*d* between the respective printing heads and a print medium in the front edges of the respective printing heads. The position of a probe line used in measurement thereof is the same as that in the first embodiment.

In the first embodiment, the more posterior the printing head was located in the direction of the travelling of the carriage, the slower the flow rate of air flowing into the space between the printing head and the print medium was. In the present embodiment, however, it is found that the stream 110*d* between one of the printing heads and the print medium with respect to the most posterior printing head 101*d* increased compared to the first embodiment. Thus, control of volumes of inflow was enabled irrespective of the positions of the printing heads in the direction of the travelling of the carriage, whereby control of airflows toward the printing heads was enabled. As a result, superiority of the present embodiment has been confirmed in terms of reduction of adherence of an ink mist onto the face surface.

As described above, pairs of the airflow guides 102, right and left with respect to the travelling direction of the carriage 105, are provided, so that the projection amounts of the respective pairs may be different from one another, at intermediate positions between adjacent two of the printing heads 101 arrayed in the travelling direction of the carriage 105. Airflows curling up toward the printing heads are controlled by the utilization of airflows generated by the airflow guides 102 thus configured to have the different projection amounts, whereby adherence of an ink mist onto the face surface of the printing heads is prevented. Thereby, an inkjet printing apparatus which enables printing with high printing quality can be obtained.

Third Embodiment

A third embodiment of the present invention will be described below with reference to the drawings. Note that, since a configuration of the present embodiment is basically the same as that of the first embodiment, only characteristic features of the configuration will be described below.

Figure 8A:
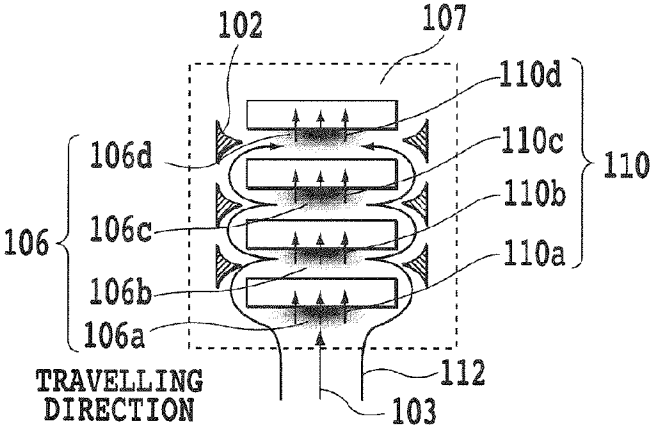
FIG. 8A is a view showing a carriage included in a printing apparatus of a third embodiment.
Figure 8B:
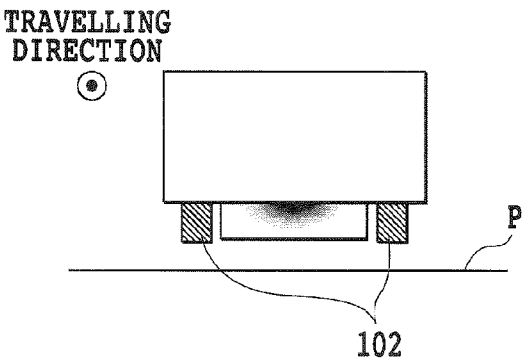
FIG. 8B is a view showing the carriage included in the printing apparatus of the third embodiment.
Figure 8C:
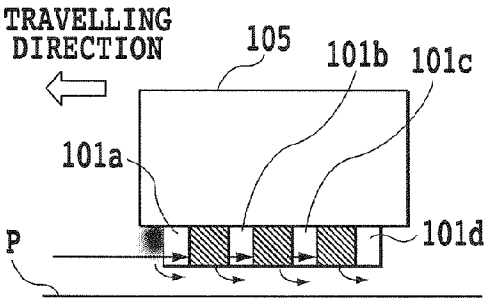
FIG. 8C is a view showing the carriage included in the printing apparatus of the third embodiment.

FIGS. 8A to 8C are views showing the carriage 105 which is included in a printing apparatus of the third embodiment, and has a structure with projecting printing heads. To the carriage 105 of the present embodiment, the airflow guides 102 whose guiding surfaces for guiding airflows are each configured as a curved surface are provided right and left from printing heads with respect to a travelling direction of the carriage 105. As in the case of the first embodiment, the airflow guides 102 of the present embodiment also are attached to the carriage surface 107 in such a way as to be movable upward downward by means of a mechanical element, such as a gear, and projection amounts of the airflow guides 102 are adjustable. Since the guiding surface for guiding airflows are each configured as a curved surface, a momentum loss of the carriage can be suppressed to a small degree as compared to guides whose respective guiding surfaces are configured as a flat surface. As a result, high-pressure regions 106 in front edges of the printing heads were more effectively formed, and streams 110 between the respective printing heads and a print medium can be obtained. Thereby, adherence of an ink mist onto the face surface of the printing heads was reduced.

As described above, pairs of the airflow guides 102 whose guiding surfaces are each configured as a curved surface are provided in intermediate positions between adjacent two of the printing heads 101 arrayed in the travelling direction of the carriage 105. Airflows curling up toward the printing heads are controlled by the utilization of airflows generated by these airflow guides 102, whereby adherence of an ink mist onto the face surface of the printing heads is prevented. Thereby, an inkjet printing apparatus enabling printing with high print quality can be obtained.

Fourth Embodiment

A fourth embodiment of the present invention will be described below with reference to the drawings. Note that, since a configuration of the present embodiment is basically the same as that of the first embodiment, only characteristic features of the configuration will be described below.

Figure 9A:
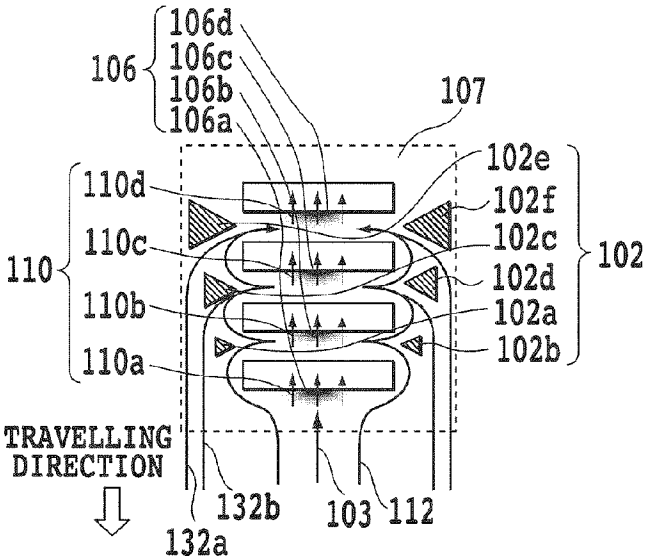
FIG. 9A is a view showing a carriage included in a printing apparatus of a fourth embodiment.
Figure 9B:
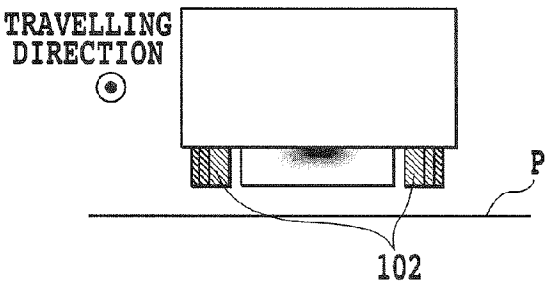
FIG. 9B is a view showing the carriage included in the printing apparatus of the fourth embodiment.
Figure 9C:
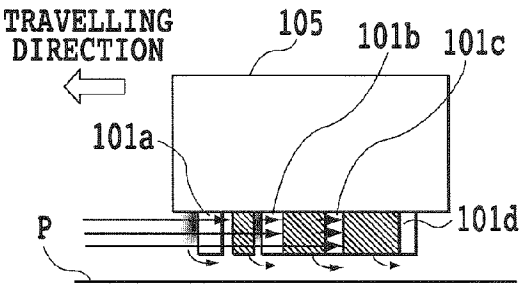
FIG. 9C is a view showing the carriage included in the printing apparatus of the fourth embodiment.

FIGS. 9A to 9C are views showing the carriage 105 which is included in a printing apparatus of the fourth embodiment, and has a structure with projecting printing heads. To the carriage 105 of the present embodiment, the airflow guides 102 are provided right and left from printing heads with respect to a travelling direction of the carriage 105. The sizes of the respective airflow guides 102*c* and 102*d* are larger than those of respective airflow guides 102*a* and 102*b*, and sizes of respective airflow guides 102*e* and 102*f* are larger than those of respective airflow guides 102*c* and 102*d*. By these formations, airflows 132 outward of more anterior ones of the guides can be guided toward front edges of following ones of the printing heads. Air which cannot be guided by more anterior ones of the airflow guides can be guided by more posterior ones of the airflow guides. Consequently, a high-pressure region 106*d* is effectively formed also in a front edge of a printing head 101*d* located even at the most posterior position, whereby favorable inflow of air into a space between this printing head and the print medium can be provided.

As described above, each pairs of the airflow guides 102 are respectively provided right and left in a direction perpendicular to a travelling direction of the carriage 105 and at intermediate positions between adjacent ones of the printing heads 101 arrayed in the travelling direction of the carriage 105. Then, the airflow guides 102 located at more posterior positions are formed to have a larger size, whereby adherence of an ink mist onto the face surface of the printing heads is prevented. Thereby, an inkjet printing apparatus enabling printing with high print quality can be obtained.

Fifth Embodiment

A fifth embodiment of the present invention will be described below with reference to the drawings. Note that, since a configuration of the present embodiment is basically the same as that of the first embodiment, only characteristic features of the configuration will be described below.

Figure 10A:
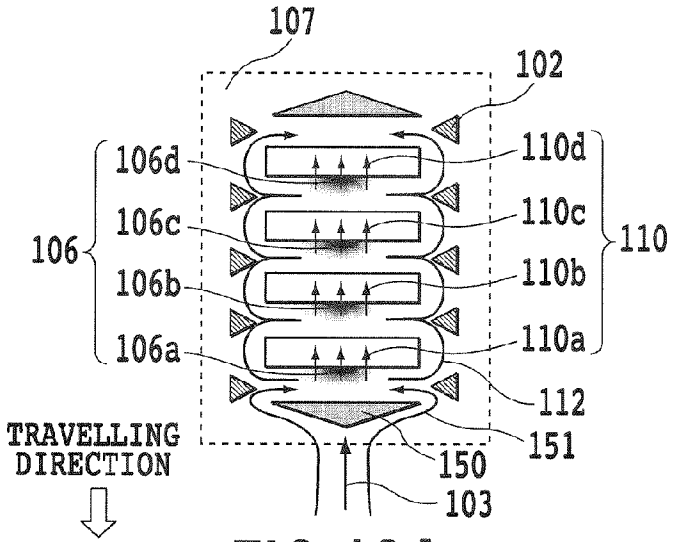
FIG. 10A is a view showing a carriage included in a printing apparatus of a fifth embodiment.
Figure 10B:
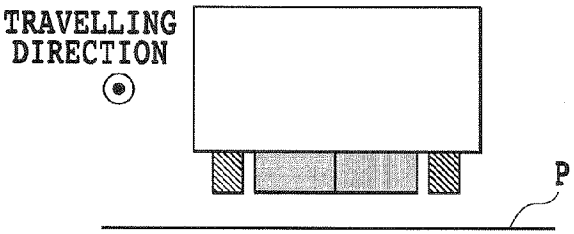
FIG. 10B is a view showing the carriage included in the printing apparatus of the fifth embodiment.
Figure 10C:
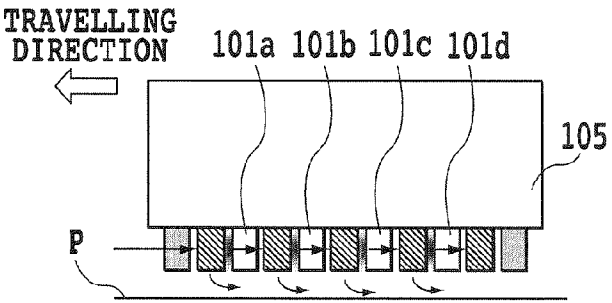
FIG. 10C is a view showing the carriage included in the printing apparatus of the fifth embodiment.

FIGS. 10A to 10C are views showing a carriage 105 which is included in a printing apparatus of the fourth embodiment, and has a structure with projecting printing heads. In the present embodiment, a forefront member 150 is provided in front of the printing head 101*a* located at the front. Therefore, excessive inflow of toward a printing head at the front in the traveling direction can be prevented. Since the carriage 105 reciprocates, the two forefront members 150 are provided for outward travelling and homeward travelling, respectively. In this case, attenuation of streams 151 flowing toward lateral surfaces of each of the forefront members 150 is prevented, whereby the high-pressure regions 106 in the front edges of the respective printing heads sufficiently develop, and lager inflow volumes into spaces between the respective printing heads and the print medium can be obtained. For that purpose, it is preferable that the forefront member 150 have a shape capable of suppressing diffusion of the streams. Although the forefront member 150 has a triangular shape in FIGS. 10A to 10C, a high effect can be expected with a streamline shape or the like.

In the first embodiment and the like, showed in FIGS. 3A to 3C, since inflows toward the printing head 101*a* located at the most anterior position are larger than those toward the printing heads 101*b* to 101*d*, pressures in the high-pressure regions of the printing heads 101*a* to 101*d* are not uniform. However, the present embodiment makes it possible to obtain uniform pressures in high-pressure regions of the printing heads 101*a* to 101*d* including the printing head 101*a* located at the most anterior position in the carriage travelling direction. Thereby, adherence of an ink mist onto face surfaces of the printing heads is prevented while high image quality is maintained.

As described above, the forefront member 150 is provided in front of the printing head 101*a* located at the most anterior position in the carriage travelling direction. Airflows curling up toward the printing heads are suppressed by this forefront member 150, whereby adherence of an ink mist onto the face surfaces of the printing heads is prevented. Thereby, an inkjet printing apparatus which enables printing with high print quality can be obtained.

Comparable Example

As an example comparable to the present invention, a carriage having a structure with projecting printing heads will be described below, the structure being configured without applying airflow guides thereto.

Figure 11A:
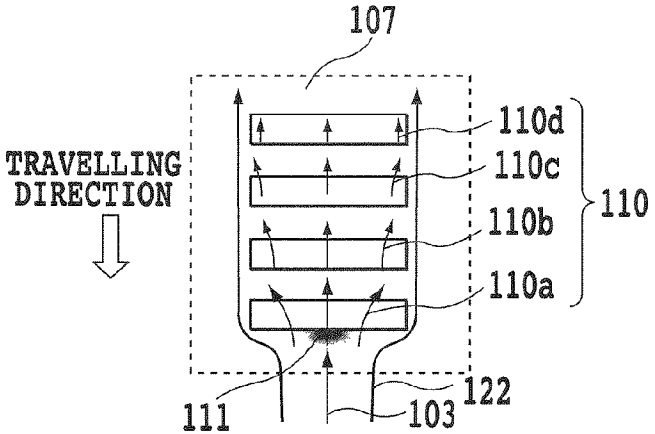
FIG. 11A is a view showing a conventional carriage and printing heads.
Figure 11B:
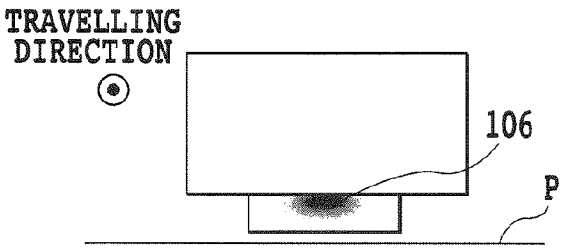
FIG. 11B is a view showing the conventional carriage and the printing heads.
Figure 11C:
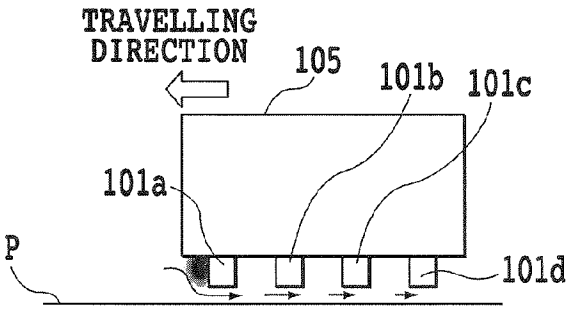
FIG. 11C is a view showing the conventional carriage and the printing heads.

FIGS. 11A to 11C are views showing conventional carriage and printing heads. If a relative system viewed from the carriage is supposed, an airflow inflowing from the front bumps into a front edge portion 111 of the first printing head 101*a*, and then largely branches into: streams 110 flowing between the respective printing heads and a print medium; and streams 122 flowing toward lateral surfaces of this printing head. Here, regarding the subsequent three printing heads, the streams 122 flowing toward the lateral surfaces of the printing head take routes as well glancing lateral surfaces of these printing heads, and never flow into the spaces between these respective printing heads and the print medium.

Furthermore, high-velocity regions are formed on the respective lateral surfaces of the printing heads, and cause pressure decreases thereon. The streams 110 flowing between the respective printing heads and the print medium flows out from regions between the respective printing heads and the print medium toward the low-pressure lateral surfaces. Consequently, as shown by the streams 110*a* to 110*d*, volumes of the streams 110 are decreased from the most anterior printing head to the most posterior printing head.

Figure 12:
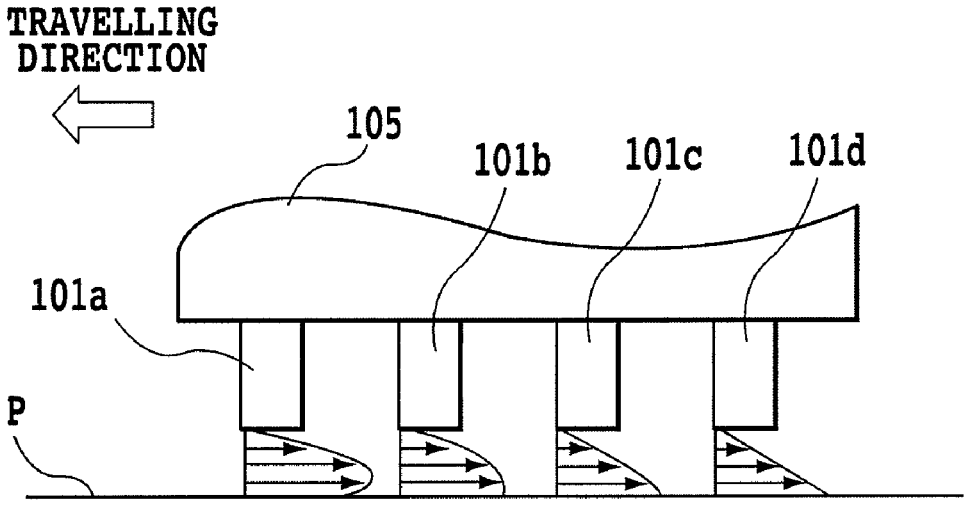
FIG. 12 is a view showing the conventional carriage and the printing heads.

FIG. 12 is a view showing a conventional carriage and printing heads. In the conventional configuration, the more posterior a printing head is located, the more closer a stream between the printing head and the print medium is to a Couette flow having a linear velocity distribution as shown in the drawing.

FIGS. 13A to 13D are diagrams showing results of a fluid simulations to which the neighborhoods of the printing heads in the conventional configuration are subjected. These diagrams are graphs showing inflow velocities of the streams 110*a* to 110*d* between the respective printing heads and the print medium P in the front edges of the respective printing heads. The position of a probe line used in measurement is the same as that in the first embodiment.

Figure 13A:
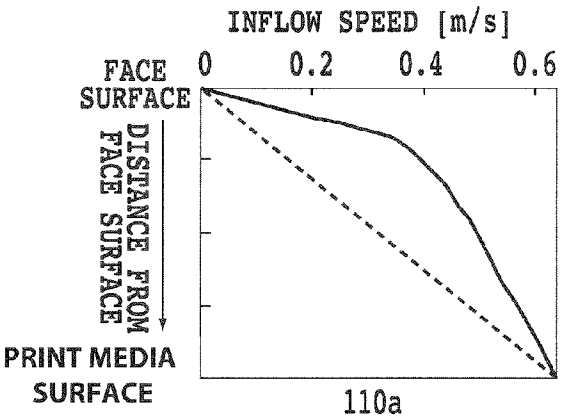
FIG. 13A is a diagram showing a result of a fluid simulation to which a neighborhood of a printing head in a conventional configuration is subjected.
Figure 13B:
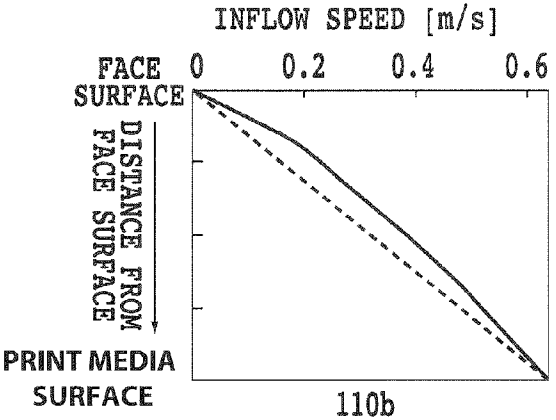
FIG. 13B is a diagram showing a result of a fluid simulation to which a neighborhood of a printing head in the conventional configuration is subjected.
Figure 13C:
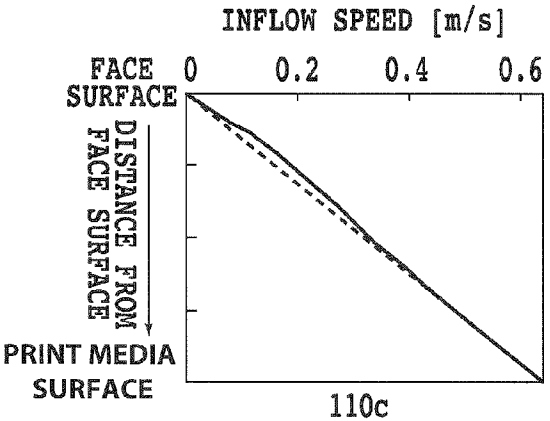
FIG. 13C is a diagram showing a result of a fluid simulation to which a neighborhood of a printing head in the conventional configuration is subjected.
Figure 13D:
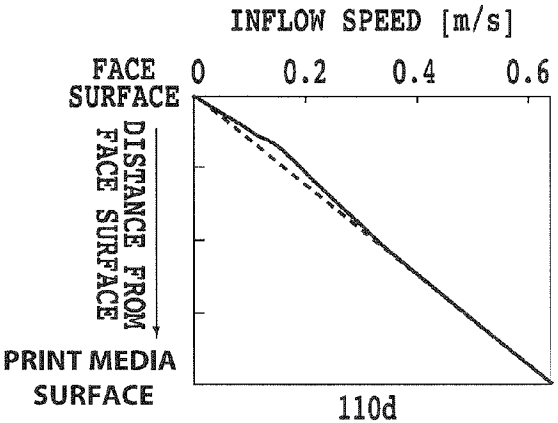
FIG. 13D is a diagram showing a result of a fluid simulation to which a neighborhood of a printing head in the conventional configuration is subjected.

According to FIG. 13A, with respect to the stream 110*a* between the printing head and the print medium in the printing head 101*a*, it is found that an inflow volume larger than an inflow volume of the Couette flow was obtained. The inflow of the Couette flow is indicated by a broken line in the graph. However, according to FIG. 13D, it is found that the more posterior a printing head was located, the smaller an airflow between the printing head and the print medium was, and that the stream 110*d* in the most posterior printing head 101*d* showed a velocity distribution closer to that of the Couette flow. Consequently, in the printing heads 101*c* shown in FIG. 13C and the printing heads 101*d* shown in FIG. 13D, airflows curling up toward the printing heads develop, whereby there occur a condition where adherence of an ink mist onto the face surfaces is likely to occur.

Thus, there are the following findings regarding the configuration having no airflow guides. One is that an increase of inflow volumes in the subsequent printing heads cannot be effectively obtained. The other is that, while inflow volumes toward the printing heads are decreased from the most anterior printing head to the most posterior printing head, inflow volumes toward the respective printing heads cannot be appropriately controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-162908, filed Jul. 9, 2009, which is hereby incorporated by reference herein in its entirety.

What is claimed is:

1. An inkjet printing apparatus for printing on a print medium by ejecting ink thereto, comprising:

a carriage configured to receive a plurality of printing heads and reciprocate, where a surface of the carriage faces the print medium;

a plurality of printing heads mounted on the carriage in parallel and projecting from the surface of the carriage; and a plurality of airflow guides projecting from the surface of the carriage, and configured to guide air, flowing alongside lateral surfaces of the respective printing heads when the carriage is in motion, into spaces between adjacent printing heads.

2. The inkjet printing apparatus according to claim 1, wherein the airflow guides are provided in pairs, and each airflow guide is disposed at a position distant from the space between adjacent printing heads, and wherein the paired airflow guides are disposed to face each other in a direction intersecting a travelling direction of the carriage.

3. The inkjet printing apparatus according to claim 1, wherein the airflow guides are each movable by a movable mechanism to change a projection amount of the airflow guide from the carriage surface.

4. The inkjet printing apparatus according to claim 3, wherein the airflow guides are capable of adjusting volumes of air flowing into spaces between the respective printing heads and the print medium, by changing the respective projection amounts from the carriage surface.

5. The inkjet printing apparatus according to claim 1, wherein the airflow guides are capable of adjusting volumes of air flowing into spaces between the respective printing heads and the print medium in a first case where the carriage travels in an outward direction and in a second case where the carriage travels in a homeward direction.

6. The inkjet printing apparatus according to claim 1, wherein an air guiding surface of each of the airflow guides is formed as a plan surface or a curved surface.

7. The inkjet printing apparatus according to claim 1, wherein the airflow guide located at the more posterior position, with respect to a travelling direction of the carriage, is capable of guiding air not guided with the airflow guide located at a more anterior position, with respect to the travelling direction of the carriage.

8. The inkjet printing apparatus according to claim 1, further comprising:

a forefront member provided in front of a most anterior one of the printing heads, with respect a travelling direction of the carriage, where the forefront member prevents excessive inflow of air into a space between the print medium and the most anterior one of the printing heads.

* * * * *